US007810327B2

(12) United States Patent
Parker

(10) Patent No.: US 7,810,327 B2
(45) Date of Patent: Oct. 12, 2010

(54) VARIABLE GEOMETRY TURBINE

(75) Inventor: John Parker, Huddersfield (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 0 days.

(21) Appl. No.: 12/148,287

(22) Filed: Apr. 17, 2008

(65) Prior Publication Data

US 2009/0064679 A1 Mar. 12, 2009

Related U.S. Application Data

(63) Continuation of application No. PCT/GB2006/003886, filed on Oct. 20, 2006.

(30) Foreign Application Priority Data

Oct. 20, 2005 (GB) ..... 0521354.1

(51) Int. Cl.
*F02D 23/00* (2006.01)
*F01D 17/12* (2006.01)
*F01D 17/14* (2006.01)

(52) U.S. Cl. ..... 60/602; 415/159; 415/158

(58) Field of Classification Search ..... 60/602; 415/158–164; *F01D 17/14*
See application file for complete search history.

(56) References Cited

U.S. PATENT DOCUMENTS

| | | | | |
|---|---|---|---|---|
| 4,526,004 | A | 7/1985 | French et al. | 60/602 |
| 5,522,697 | A * | 6/1996 | Parker et al. | 415/158 |
| 6,203,272 | B1 * | 3/2001 | Walsham | 415/158 |
| 6,726,447 | B2 * | 4/2004 | Lutz | 415/158 |
| 6,932,565 | B2 * | 8/2005 | Garrett et al. | 415/158 |
| 7,024,855 | B2 * | 4/2006 | Perrin et al. | 60/602 |
| 7,207,176 | B2 * | 4/2007 | Mulloy et al. | 60/602 |
| 2004/0128997 | A1 | 7/2004 | Parker | 60/602 |
| 2005/0060999 | A1 * | 3/2005 | Mulloy et al. | 60/602 |
| 2007/0227603 | A1 * | 10/2007 | Perrin et al. | 138/43 |
| 2008/0223039 | A1 * | 9/2008 | Sumser et al. | 60/612 |

(Continued)

FOREIGN PATENT DOCUMENTS

DE 3026558 A1 * 1/1982

(Continued)

OTHER PUBLICATIONS

GB0521354.1 (Search Report) Jan. 20, 2006, Holset Engineering Co.

(Continued)

*Primary Examiner*—Thai Ba Trieu
(74) *Attorney, Agent, or Firm*—Krieg DeVault LLP; J. Bruce Schelkopf, Esq.

(57) ABSTRACT

A variable geometry turbine comprises a turbine wheel supported in a housing for rotation about a turbine axis with an annular inlet passageway defined between a radial face of a movable nozzle ring and a facing wall of the housing. The nozzle ring is movable along the turbine axis to vary the width of the inlet passageway. A substantially annular rib is provided either on the face of the nozzle ring (such that the minimum width of the inlet passageway is defined between the rib and the facing wall of the housing) or on the facing wall of the housing (such that the minimum width of the inlet passageway is defined between the rib and the nozzle ring).

30 Claims, 12 Drawing Sheets

U.S. PATENT DOCUMENTS

| | | | | |
|---|---|---|---|---|
| 2009/0016875 | A1 * | 1/2009 | Noelle | 415/148 |
| 2009/0097969 | A1 * | 4/2009 | Spuler | 415/159 |
| 2009/0142186 | A1 * | 6/2009 | Parker | 415/159 |

FOREIGN PATENT DOCUMENTS

| | | | |
|---|---|---|---|
| DE | 3100879 | A1 * | 8/1982 |
| DE | 4303521 | C1 * | 1/1994 |
| DE | 4303520 | C1 | 9/1994 |
| EP | 0080810 | A1 | 6/1983 |
| EP | 0131406 | A2 | 7/1983 |
| EP | 0654587 | A1 | 5/1995 |
| EP | 1260675 | A1 * | 11/2002 |
| EP | 1375826 | A1 | 1/2004 |
| EP | 1435434 | A2 | 2/2004 |
| WO | WO 2005059317 | A1 * | 6/2005 |

OTHER PUBLICATIONS

PCT/GB2006/003886, Search Report and Written Opinion Jan. 30, 2007, Holset Engineering Co.

* cited by examiner

VARIABLE GEOMETRY TURBINE

The present application is a continuation of PCT/GB2006/003886 filed on Oct. 20, 2006 which claims the benefit of United Kingdom Patent Application No. GB0521354.1 filed Oct. 20, 2005, which are incorporated herein by reference.

FIELD OF THE INVENTION

The present invention relates to a variable geometry turbine and to methods of controlling a variable geometry turbine. Particularly, but not exclusively, the present invention relates to variable geometry turbochargers and more particularly still to turbochargers operated to control engine braking or to affect the exhaust gas temperature of an internal combustion engine.

BACKGROUND

Turbochargers are well known devices for supplying air to the intake of an internal combustion engine at pressures above atmospheric pressure (boost pressures). A conventional turbocharger essentially comprises an exhaust gas driven turbine wheel mounted on a rotatable shaft within a turbine housing connected downstream of an engine outlet manifold. Rotation of the turbine wheel rotates a compressor wheel mounted on the other end of the shaft within a compressor housing. The compressor wheel delivers compressed air to the engine intake manifold. The turbocharger shaft is conventionally supported by journal and thrust bearings, including appropriate lubricating systems, located within a central bearing housing connected between the turbine and compressor wheel housings.

In turbochargers, the turbine stage comprises a turbine chamber within which the turbine wheel is mounted; an annular inlet passageway defined between facing radial walls arranged around the turbine chamber; an inlet arranged around the inlet passageway; and an outlet passageway extending from the turbine chamber. The passageways and chambers communicate such that pressurised exhaust gas admitted to the inlet chamber flows through the inlet passageway to the outlet passageway via the turbine and rotates the turbine wheel. Turbine performance can be improved by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suite varying engine demands. For instance, when the volume of exhaust gas being delivered to the turbine is relatively low, the velocity of the gas reaching the turbine wheel is maintained at a level which ensures efficient turbine operation by reducing the size of the annular inlet passageway. Turbochargers provided with a variable geometry turbine are referred to as variable geometry turbochargers.

In one type of variable geometry turbine, an axially moveable wall member, generally referred to as a "nozzle ring", defines one wall of the inlet passageway. The position of the nozzle ring relative to a facing wall of the inlet passageway is adjustable to control the axial width of the inlet passageway. Thus, for example, as gas flow through the turbine decreases, the inlet passageway width may be decreased to maintain gas velocity and optimise turbine output.

The nozzle ring may be provided with vanes which extend into the inlet and through slots provided in a "shroud" defining the facing wall of the inlet passageway to accommodate movement of the nozzle ring. Alternatively vanes may extend from the fixed facing wall and through slots provided in the nozzle ring.

Typically the nozzle ring may comprise a radially extending wall (defining one wall of the inlet passageway) and radially inner and outer axially extending walls or flanges which extend into an annular cavity behind the radial face of the nozzle ring. The cavity is formed in a part of the turbocharger housing (usually either the turbine housing or the turbocharger bearing housing) and accommodates axial movement of the nozzle ring. The flanges may be sealed with respect to the cavity walls to reduce or prevent leakage flow around the back of the nozzle ring. In one common arrangement the nozzle ring is supported on rods extending parallel to the axis of rotation of the turbine wheel and is moved by an actuator which axially displaces the rods.

Nozzle ring actuators can take a variety of forms, including pneumatic, hydraulic and electric and can be linked to the nozzle ring in a variety of ways. The actuator will generally adjust the position of the nozzle ring under the control of an engine control unit (ECU) in order to modify the airflow through the turbine to meet performance requirements.

One example of a variable geometry turbocharger of this general type is disclosed in EP 0654587. This discloses a nozzle ring as described above which is additionally provided with pressure balancing apertures through its radial wall. The pressure balancing apertures ensure that pressure within the nozzle ring cavity is substantially equal to, but always slightly less than, the pressure applied to the nozzle ring face by gas flow through the inlet passageway. This ensures that there is only a small unidirectional force on the nozzle ring which aids accurate adjustment of the nozzle ring position, particularly when the nozzle ring is moved close to the opposing wall of the inlet to reduce the inlet passageway towards its minimum width.

In addition to the control of a variable geometry turbocharger in an engine fired mode (in which fuel is supplied to the engine for combustion) to optimise gas flow, it is possible to take advantage of the facility to minimise the turbocharger inlet area to provide an engine braking function in an engine braking mode (in which no fuel is supplied for combustion) in which the inlet passageway is reduced to smaller areas than in a normal fired mode operating range.

Engine brake systems of various forms are widely fitted to vehicle engine systems, in particular to compression ignition engines (diesel engines) used to power large vehicles such as trucks. The engine brake systems may be employed to enhance the effect of the friction brakes acting on the vehicle wheels or, in some circumstances, may be used independently of the normal wheel braking system, for instance to control down hill speed of a vehicle. With some engine brake systems, the brake is set to activate automatically when the engine throttle is closed (i.e. when the driver lifts his foot from the throttle pedal), and in others the engine brake may require manual activation by the driver, such as depression of a separate brake pedal.

In one form of an engine brake system an exhaust valve in the exhaust line is controlled to substantially block the engine exhaust when braking is required. This produces an engine braking torque by generating a high backpressure that increases the work done on the engine piston during the exhaust stroke. U.S. Pat. No. 4,526,004 discloses such an engine braking system for a turbocharged engine in which the exhaust valve is provided in the turbine housing of a fixed geometry turbocharger.

With a variable geometry turbine, it is not necessary to provide a separate exhaust valve. Rather, the turbine inlet passageway may simply be "closed" to a minimum flow area when braking is required. The level of braking may be modulated by control of the inlet passageway size by appropriate control of the axial position of the nozzle ring. In a "fully closed" position in an engine braking mode the nozzle ring may in some cases abut the facing wall of the inlet passage. In some exhaust brake systems known as decompression brake systems, an in-cylinder decompression valve arrangement is controlled to release compressed air from the engine cylinder into the exhaust system to release work done by the compression process. In such systems closure of the turbine inlet both increases back pressure and provides boost pressure to maximise compression work.

It is important to allow some exhaust gas flow through the engine during engine braking in order to prevent excessive heat generation in the engine cylinders. Thus there must be provision for at least a minimum leakage flow through the turbine when the nozzle ring is in a fully closed position in an engine braking mode. In addition, the high efficiency of modern variable geometry turbochargers can generate such high boost pressures even at small inlet widths that use an engine braking mode can be problematic as cylinder pressures can approach or exceed acceptable limits unless counter measures are taken (or braking efficiency is sacrificed). This can be a particular problem with engine brake systems including a decompression braking arrangement.

An example of a variable geometry turbocharger which includes measures for preventing generation of excessive pressures in the engine cylinders when operated in an engine braking mode is disclosed in EP 1435434. This discloses a nozzle ring arrangement provided with bypass apertures that provide a bypass path that opens when the nozzle ring approaches a closed position to allow some exhaust gas to flow from the turbine inlet chamber to the turbine wheel through the nozzle ring cavity thereby bypassing the inlet passageway. The bypass gas flow does less work than gas flowing through the inlet passageway so that with the bypass passageway open the turbine efficiency drops preventing excessive pressure generation within the engine cylinders. In addition, the bypass gas flow can provide, or contribute to, the minimum flow required to avoid excessive heat generation during engine braking.

A variable geometry turbocharger can also be operated in an engine fired mode so as to close the inlet passageway to a minimum width less than the smallest width appropriate to normal engine operating conditions in order to control exhaust gas temperature. The basic principle of operation in such an "exhaust gas heating mode" is to reduce the amount of airflow through the engine for a given fuel supply level (whilst maintaining sufficient airflow for combustion) in order to increase the exhaust gas temperature. This has particular application where a catalytic exhaust after-treatment system is present.

Catalytic exhaust after-treatment system performance is directly related to the temperature of the exhaust gas that passes through it. For desired performance the exhaust gas temperature must be above a threshold temperature (typically lying in a range of about 250° C. to 370° C.) under all engine operating conditions and ambient conditions. Operation of the after-treatment system below the threshold temperature range will cause the after-treatment system to build up undesirable accumulations which must be burnt off in a regeneration cycle to allow the after-treatment system to return to designed performance levels. In addition, prolonged operation of the after-treatment system below the threshold temperature without regeneration will disable the after-treatment system and cause the engine to become non-compliant with government exhaust emission regulations.

For the majority of the operation range of a diesel engine for instance, the exhaust gas temperature will generally be above the required threshold temperature. However, in some conditions, such as light load conditions and/or cold ambient temperature conditions, the exhaust gas temperature can often fall below the threshold temperature.

In engine operating conditions, such as light load conditions, in which exhaust temperature might otherwise drop below the required threshold temperature the turbocharger can in principle be operated in an exhaust gas heating mode to reduce the turbine inlet passageway width with the aim of restricting airflow thereby reducing the airflow cooling effect and increasing exhaust gas temperature. However a potential problem with operation of a modern efficient turbocharger in this way is that increased boost pressures achieved at small inlet widths can actually increase the airflow offsetting the effect of the restriction, thus reducing the heating effect and possibly preventing any significant heating at all.

The above problems with exhaust gas heating mode operation of a variable geometry turbocharger are addressed in US published patent application No. US2005/0060999A1. This teaches using the turbocharger nozzle ring arrangement of EP 1435434 (mentioned above) in an exhaust gas heating mode. The bypass gas path is arranged to open at inlet passageway widths smaller than those appropriate to normal fired mode operation conditions but which are appropriate to operation in an exhaust gas heating mode. As in braking mode, the bypass gas flow reduces turbine efficiency thus avoiding high boost pressures which might otherwise counter the heating effect. In addition to the bypass gas path, pressure balancing apertures (as taught in EP 0654587 mentioned above) may be provided to aid control of the nozzle ring position in an exhaust gas heating mode.

Whether operated in an engine braking mode (with or without a decompression brake system) or an exhaust gas heating mode, control of the nozzle ring position at very small inlet widths can be problematic as there can be a rapid increase in the load on the nozzle ring as it approaches a closed position. Even with the provision of pressure balancing apertures as mentioned above there can be a tendency for the nozzle ring to "snap" shut as it approaches close to the opposing wall of the inlet. In addition it can require a very large force to open a nozzle ring which abuts the opposing wall of the inlet when in a fully closed position. It can also be difficult to ensure that there is always an optimum minimum flow through the turbine when the nozzle ring is in a fully closed position.

SUMMARY

It is an object of some embodiments of the present invention to obviate or mitigate the above disadvantages.

According to a first aspect of the present invention there is provided a variable geometry turbine comprising;

a turbine wheel supported in a housing for rotation about a turbine axis;

an annular inlet passageway defined between a radial face of a movable wall member and a facing wall of the housing;

the movable wall member being movable along the turbine axis to vary the width of the inlet passageway;

wherein a substantially annular rib is provided on said radial face such that the minimum width of the inlet passageway is defined between the rib and a portion of the facing wall of the housing.

According to a second aspect of the present invention there is provided a variable geometry turbine comprising;

a turbine wheel supported in a housing for rotation about a turbine axis;

an annular inlet passageway defined between a radial face of a movable wall member and a facing wall of the housing;

the movable wall member being movable along the turbine axis to vary the width of the inlet passageway;

wherein a substantially annular rib is provided on said facing wall of the housing such that the minimum width of the inlet passageway is defined between the rib and a portion of the face of the movable wall member With the present invention the area of the inlet may be precisely defined by the rib which enables more accurate control of the inlet area at all positions of the moveable wall member as described further below. Other advantages of the rib will also be apparent from the detailed description below.

The movable wall member is preferably movable into a fully closed position in which it abuts the housing. Thus may seal the inlet passageway or the rib and/or said portion of the facing wall of the housing (or face of the movable wall member) may be provided with at least one gas passage formation which defines at least part of a gas passage when the movable wall member is in said fully closed position to allow gas to flow through the inlet passageway past the rib. For instance, circumferentially spaced array of slots, may be provided in the rib.

The provision of slots in the rib, or other gas passage formations, ensures a minimum gas flow through the inlet. For instance, where the turbine forms part of a turbocharger fitted to a combustion engine, provision of a minimum gas flow when the moveable wall member is in a fully closed position allows the movable wall member to be moved in to the fully closed position in an exhaust gas heating or engine braking mode as described more fully below.

Preferably an annular array of inlet vanes extends across said inlet passageway, such that said rib circumscribes said inlet vanes, vane passages being defined between adjacent vanes.

The turbine according to the present invention may include structure to provide for a bypass gas flow around the inlet when the nozzle ring is in a closed position to reduce efficiency of the turbine as taught in EP 1435434.

Similarly, the moveable annular wall member may be provided with pressure balancing holes as disclosed in EP 0 654 587 mentioned above. In some embodiments the pressure balancing holes may be combined with bypass passage structure as taught in EP 1 435 434.

Turbochargers fitted with a variable geometry turbine according to the present invention are particularly suited for operation in an engine braking or exhaust gas heating mode. Thus, the present invention also provides a turbocharger including a turbine according to the first and second aspects of the invention mentioned above.

According to a third aspect of the present invention there is provided a method comprising:

operating a turbocharger according to the present invention fitted to an internal combustion engine in an engine braking mode in which a fuel supply to the engine is stopped and the movable wall member is moved to reduce the width of the turbine inlet passageway.

According to a fourth aspect of the present invention there is provided a method comprising:

operating a turbocharger according to the present invention fitted to an internal combustion engine in an exhaust gas heating mode in which the width of the inlet is reduced below a width appropriate to a normal engine operating range to raise the temperature of exhaust gas passing through the turbine.

Other preferred and advantageous features of the various aspects of the present invention will be apparent from the following description.

BRIEF DESCRIPTION OF THE DRAWINGS

Specific embodiments of the present invention will now be described, by way of example only, with reference to the accompany drawings, in which.

DETAILED DESCRIPTION OF PREFERRED EMBODIMENTS

Figure 1:
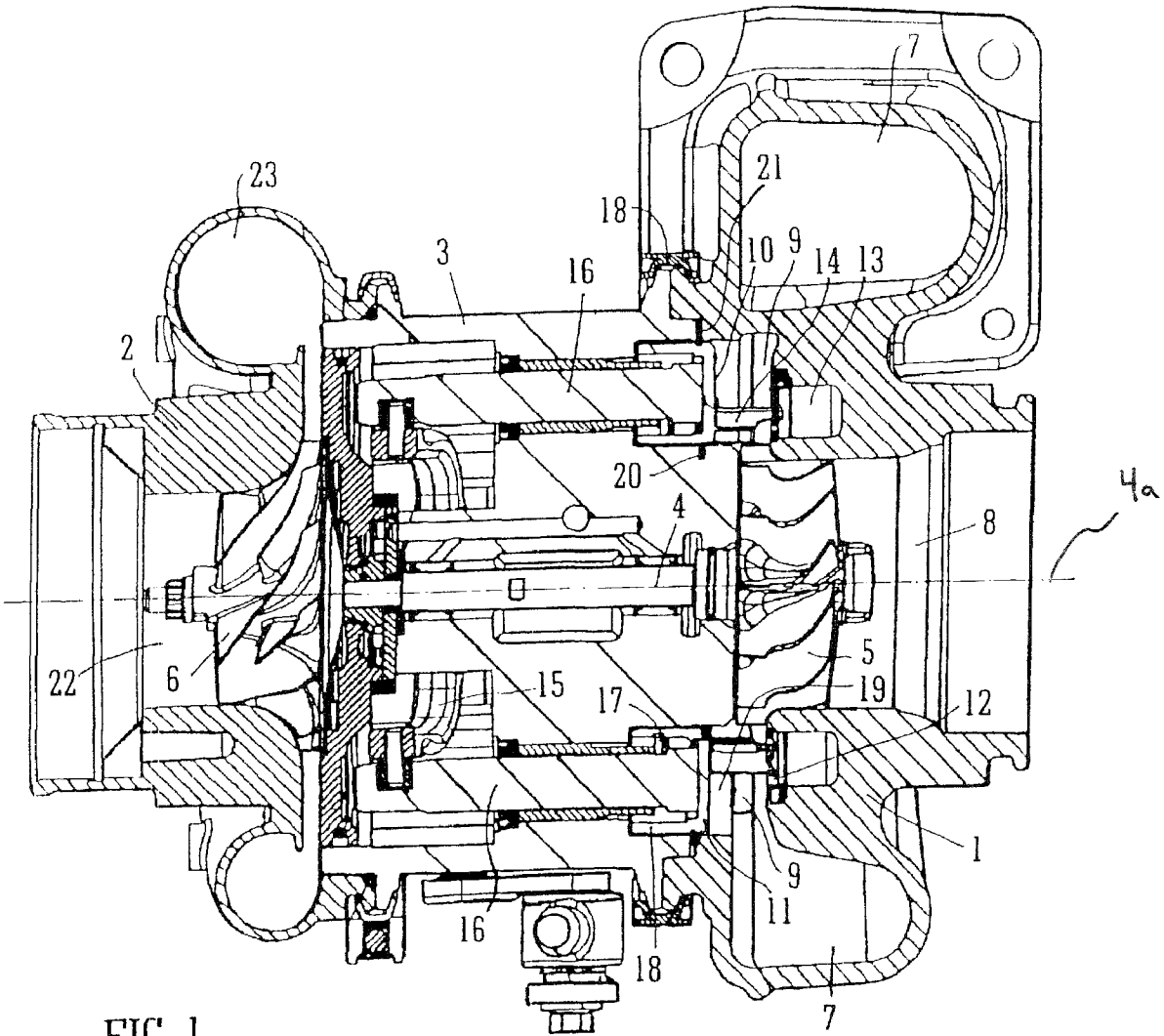
FIG. 1 is an axial cross-section through a variable geometry turbocharger.

Referring to FIG. 1, the illustrated variable geometry turbocharger comprises a variable geometry turbine housing 1 and a compressor housing 2 interconnected by a central bearing housing 3. A turbocharger shaft 4 extends from the turbine housing 1 to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis 4*a* on bearing assemblies located in the bearing housing.

The turbine housing 1 defines an inlet chamber 7 (typically a volute) to which gas from an internal combustion engine (not shown) is delivered. The exhaust gas flows from the inlet chamber 7 to an axle outlet passageway 8 via an annular inlet passageway 9 and turbine wheel 5. The inlet passageway 9 is defined on one side by the face 10 of a radial wall of a movable annular wall member 11, commonly referred to as a "nozzle ring", and on the opposite side by an annular shroud 12 which forms the wall of the inlet passageway 9 facing the nozzle ring 11. The shroud 12 covers the opening of an annular recess 13 in the turbine housing 1.

The nozzle ring 11 supports an array of circumferentially and equally spaced inlet vanes 14 each of which extends across the inlet passageway 9. The vanes 14 are orientated to deflect gas flowing through the inlet passageway 9 towards the direction of rotation of the turbine wheel 5. When the nozzle ring 11 is proximate to the annular shroud 12, the vanes 14 project through suitably configured slots in the shroud 12, into the recess 13.

A pneumatic actuator (not shown) is operable to control the position of the nozzle ring 11 via an actuator output shaft (not shown), which is linked to a stirrup member 15. The stirrup member 15 in turn engages axially extending guide rods 16 that support the nozzle ring 11. Accordingly, by appropriate control of the actuator (which may for instance be pneumatic or electric), the axial position of the guide rods 16 and thus of the nozzle ring 11 can be controlled. It will be appreciated that details of the nozzle ring mounting and guide arrangements may differ from those illustrated.

The nozzle ring 11 has axially extending radially inner and outer annular flanges 17 and 18 that extend into an annular cavity 19 provided in the turbine housing 1. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 21 is supported within an annular groove formed in the radially outer annular surface of the cavity 19 and bears against the outer annular flange 18 of the nozzle ring 11. It will be appreciated that the inner and/or outer sealing rings could be mounted in a respective annular groove in the nozzle ring flanges rather than as shown (See for instance FIG. 2*a*).

Gas flowing from the inlet chamber 7 to the outlet passageway 8 passes over the turbine wheel 5 and as a result torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown). The speed of the turbine wheel 5 is dependent upon the velocity of the gas passing through the annular inlet passageway 9. For a fixed rate of mass of gas flowing into the inlet passageway, the gas velocity is a function of the width of the inlet passageway 9, the width being adjustable by controlling the axial position of the nozzle ring 11. (As the width of the inlet passageway 9 is reduced, the velocity of the gas passing through it increases.) FIG. 1 shows the annular inlet passageway 9 fully open. The inlet passageway 9 may be closed to a minimum appropriate to different operating modes by moving the face 10 of the nozzle ring 11 towards the shroud 12.

In an engine braking mode fuel supplied to the engine is stopped and the nozzle ring 11 is moved to so that the turbine inlet 9 is closed down to a width which will generally be much smaller than the minimum width appropriate to normal engine fired mode operation. The minimum width to which the turbocharger inlet can be closed may have to be limited to avoid generating excessive boost pressures and over pressurizing the engine cylinders. Limiting the minimum inlet width in this way can however compromise braking performance. Alternatively, as disclosed in EP1435434, measures can be taken to provide a minimum flow which bypasses the normal inlet passage 9 at small inlet widths appropriate to an engine braking operating mode. This reduces turbine efficiency to avoid over pressurizing the engine cylinders. In some cases it may be necessary for the nozzle ring 11 to be maintained at a minimum inlet width position for a prolonged period of time, such as for instance when the engine brake is used to control the speed of a large vehicle travelling on a long downhill descent.

In an exhaust gas heating mode the nozzle ring 11 is moved to reduce the size of the inlet passageway in response to the temperature within an after-treatment system dropping below a threshold temperature. The temperature within the after-treatment system may for instance be determined by a temperature detector which may either operate to detect the gas temperature at discrete time intervals or in a continuous or almost continuous manner. If during fired mode operation the temperature within the after-treatment system is determined to be below a threshold value the nozzle ring 11 is moved to reduce the inlet width to restrict air flow sufficiently to cause the exhaust gas temperature to rise without preventing the air flow necessary for combustion within the engine cylinders. The nozzle ring 11 may be maintained at the minimum width position, which will generally be below the minimum width appropriate to a normal fired mode operation, until the detected temperature is at or above the threshold temperature. In some cases it may be necessary to hold the nozzle ring 11 at the minimum position for a sustained period of time.

As with engine braking mode, high turbine efficiency can be problematic when operating the turbocharger at a small turbine inlet width in an exhaust heating mode. For instance, as mentioned above US Patent Application No. 2005/0060999A1 teaches use of the nozzle ring bypass arrangement of EP1435434 for use when controlling a turbocharger in an exhaust gas heating mode As discussed above, the closed position of the nozzle ring 11, and hence the minimum width of the inlet passageway 9, may vary between the different operating modes. For instance, in a normal fired operating mode the minimum inlet width may be relatively large, typically of the order of 3-12 millimetres. However in an engine braking mode or exhaust gas heating mode the minimum width will generally be less than the minimum width used in normal fired mode. Typically, the minimum width in an engine braking mode or exhaust gas heating mode will be less than 4 millimetres. It will, however, be appreciated that the size of the minimum width will to some extent be dependent upon the size and configuration of the turbine. Typically, the minimum width for a turbine inlet for an engine operating in normal fired mode will not be less than about 25% of the maximum inlet width, but will typically be less than 25% of the maximum gap width in an engine braking or exhaust gas heating mode.

It will be appreciated that although closure of the turbine inlet during engine exhaust gas heating 9 is quite different to the effect of closing the inlet during engine braking, similar problems are encountered. There is a need to avoid excessive engine cylinder pressures and temperatures; the requirement accurately control the position of the nozzle ring at very small inlet passageway widths at which the load balance on the nozzle ring can be sensitive to nozzle ring movement; and the desire to control in a predictable manner, and to optimise, the level of the minimum gas flow through the turbine when the inlet is closed to a minimum Referring now to FIGS. 2*a* and 2*b*, these are schematic cross-sections through part of a variable geometry turbine inlet of the general type shown in FIG. 1. Accordingly, like reference numerals are used where appropriate. The views are cross-sectional views corresponding to the cross-sectional views shown in FIG. 1, and show a nozzle ring 11 supporting vanes 14 which extend across an annular inlet passage 9 between a turbine inlet chamber 7 and turbine wheel 5. The nozzle ring 11 is axially slideable within a nozzle ring cavity 19. Radially inner and outer annular flanges 17 and 18 of the nozzle ring 11 are sealed with respect to the cavity 19 by annular seal members 20 and 21 which in this example are located in grooves provided in the respective flanges 17, 18 rather than grooves formed in the cavity walls. The inlet passageway 9 is defined on one side by the face 10 of the nozzle ring 11 and on the other by a shroud 12. The shroud 12 is provided with slots (not visible in these figures) which allow the vanes 14 to pass through the shroud 12 into a recess 13 in order to accommodate axial movement of the nozzle ring 12 to vary the inlet width between the face of the nozzle ring 10 and the shroud 12.

Figure 2A:
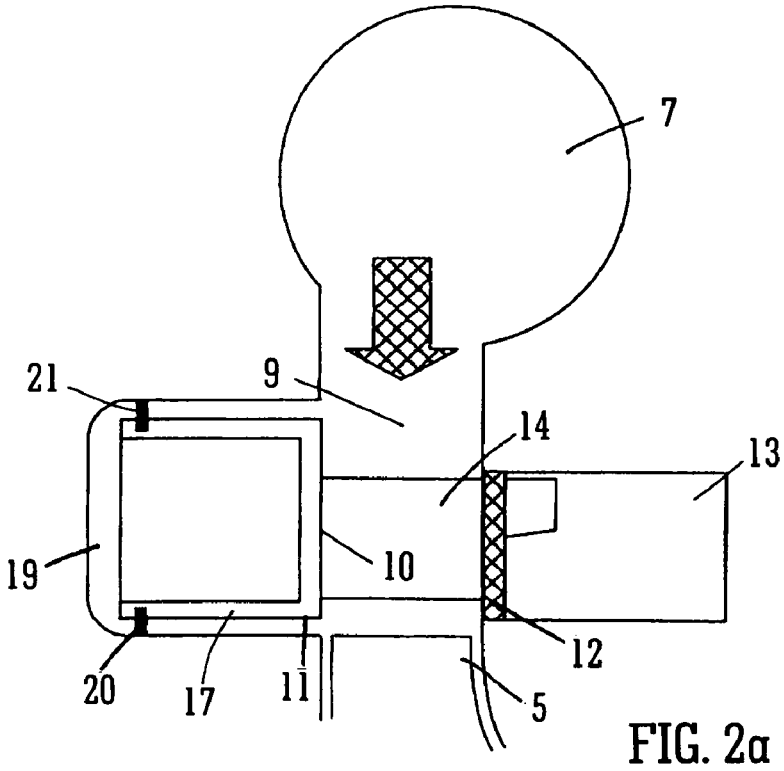
FIGS. 2*a* and 2*b* are cross-sections through part of a variable geometry turbine inlet structure schematically illustrating the inlet structure of the turbine of FIG. 1.

In FIG. 2*a* the nozzle ring is shown in an open position so that the width of the inlet passageway 9 defined between the nozzle ring face 10 and the shroud 12 is relatively large. The position shown is not necessarily the 'fully' open position, as in some turbochargers it may be possible to withdraw the nozzle ring 11 further into the nozzle ring cavity 19 as for instance illustrated in FIG. 1.

Figure 2B:
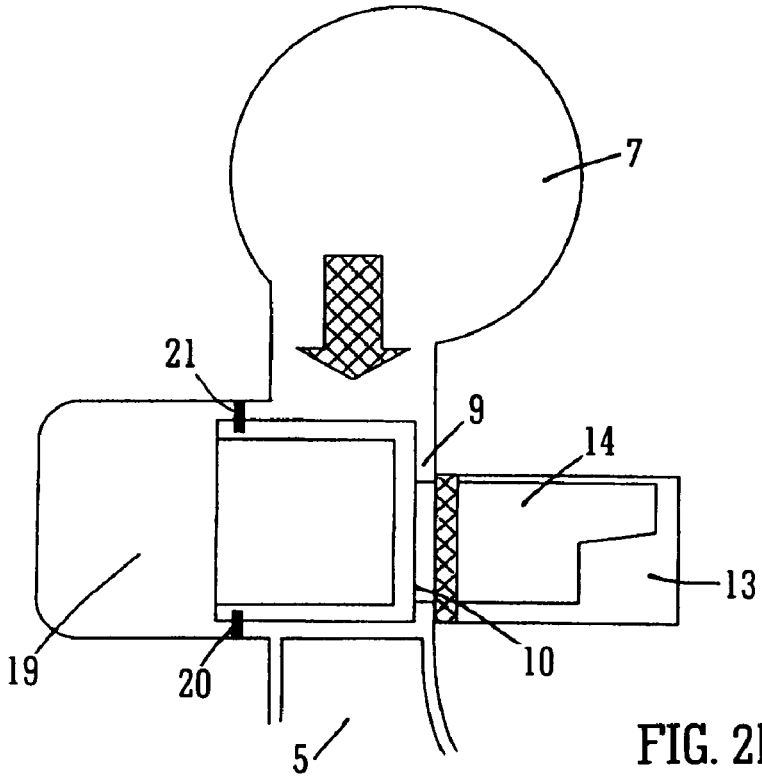

In FIG. 2*b* the nozzle ring 11 is shown in a closed position in which the face 10 of the nozzle ring 11 is moved close to the shroud 12 to reduce the width of the inlet passageway 9 towards a minimum.

As mentioned, in an engine braking mode or exhaust gas heating mode at least a small leakage flow must be allowed when the inlet 9 is closed to a minimum width. This can for instance be achieved either by ensuring that the inlet width is greater than zero or by providing an appropriate leakage path around the inlet if in a fully closed position the inlet width is zero. However, the minimum flow should not be too large or the braking efficiency or exhaust gas heating effect may be compromised.

Figure 3B:
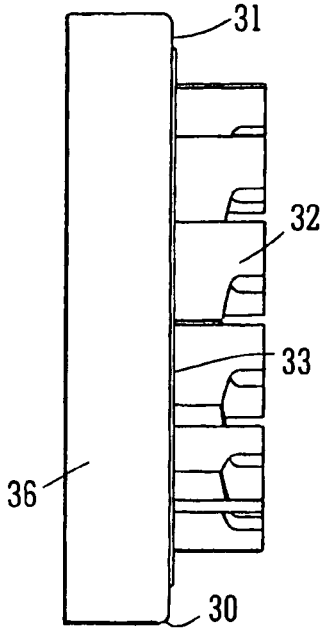
FIGS. 3*a* and 3*b* illustrate a nozzle ring according to one embodiment of the present invention.
Figure 3A:
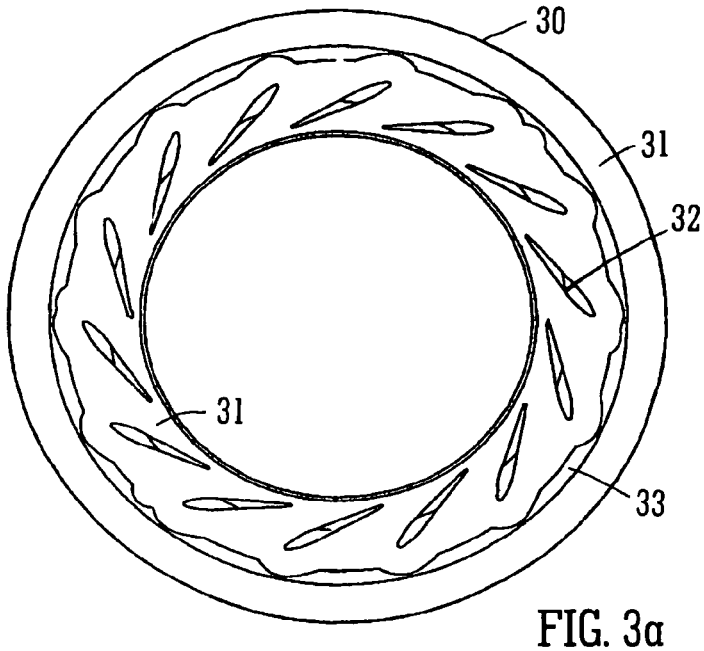

FIGS. 3*a* and 3*b* are front and side views respectively of a nozzle ring 30 according to an embodiment of the present invention. The nozzle ring 30 is of the general type shown in FIG. 1 and illustrated schematically in FIGS. 2*a* and 2*b*. The nozzle ring 30 has a radially extending wall defining the nozzle ring face 31, a radially outer annular flange 36 and an radially inner annular flange (not visible in these views). A circumferential array of inlet vanes 32 extend from the face 31 of the nozzle ring 30. Nozzle ring 30 includes an annular rib 33 extending axially from the face 31 of the nozzle ring 30 circumscribing the inlet vanes 32. In this particular embodiment, the radially inner profile of the rib 33 has radial indentations resulting from machining of the face of the nozzle ring 30 to define the rib 33 and the vanes 32 with the result that the radial width of the rib 33 varies around its circumference. This profile is not necessary to the function of the rib 33. The width of the rib 33 could for instance be uniform, have different variation or location, and could be greater or smaller than that illustrated.

Figure 4:
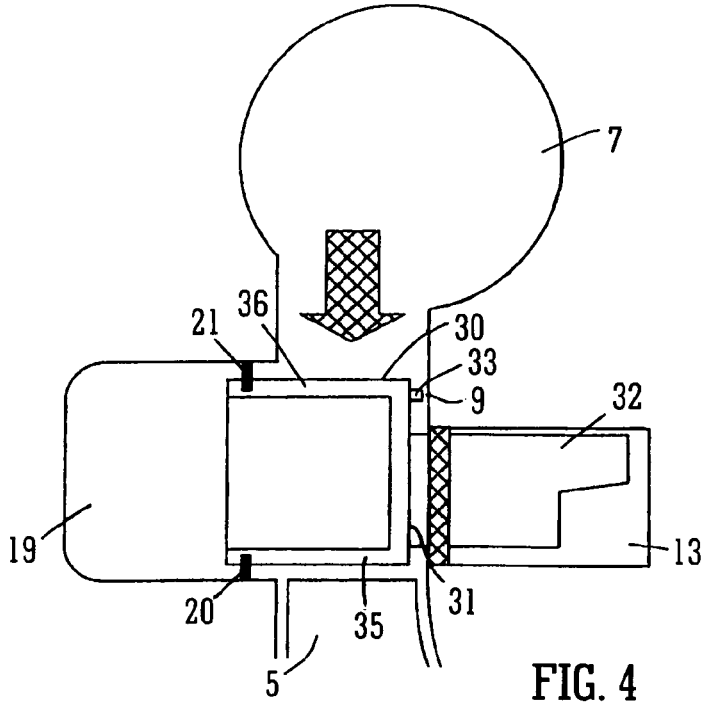
FIG. 4 illustrates a cross-section through the inlet of a variable geometry turbine according to the present invention, including the nozzle ring of FIGS. 3*a* and 3*b;*

FIG. 4 is a schematic illustration corresponding to FIG. 2*b* but including a nozzle ring according to the present invention as illustrated in FIGS. 3*a* and 3*b*. Where appropriate the reference numerals used in FIG. 2*a* are retained. Inner and outer nozzle ring seals 20 and 21 seal the nozzle ring flanges 35 and 36 with respect to the nozzle ring cavity 19. The seals 20 and 21 seat in annular grooves (not shown in FIGS. 3*a* and 3*b*) provided in respective flanges 35 and 36.

It can be seen that with a nozzle ring 30 according to the present invention the minimum width of the inlet 9 is defined not between the face 31 of the nozzle ring 30 and shroud 12, but rather between the rib 33 and the shroud 12. This provides advantages over the prior art as discussed below.

In a variable geometry turbine with a moveable nozzle ring, the nozzle ring is secured to support structure, such as for instance guide rods as shown in FIG. 1, using rivets or other fasteners (not shown) the heads of which are typically exposed on the face of the nozzle ring. In such cases abutment of the rivets against the shroud defining the opposing wall of the turbine inlet limits the minimum achievable inlet width defined between the face of the nozzle ring and the opposing shroud. Although not necessarily a problem for operation in a normal engine fired mode, the resultant inlet size can result in an undesirably large minimum flow when the nozzle ring is closed in an engine braking or exhaust gas heating mode.

This problem is avoided with embodiments of the present invention in which the rib 33 extends above the face 31 of the nozzle ring 30 to a height greater than the height of any exposed rivet head or the like, so that the rib 33 defines the portion of the nozzle ring 30 extending closest to the opposing wall 12 of the inlet passageway 9. The minimum width of the inlet 9 can thus be precisely controlled, and can if desired be reduced to widths (including zero) smaller than might be achievable with a nozzle ring. Moreover, any exposed rivet heads limiting the inlet width with a nozzle ring with have a differing effect on the minimum area of the turbine inlet depending on the size of the turbine. With the present invention the inlet area can be controlled to any value regardless of the size of the turbine.

In addition to improving the ability to specify any desired minimum width of the inlet passageway 9, the provision of the rib 33 on the face 31 of the nozzle ring 30 can also be expected to reduce the efficiency vs. inlet width characteristic of the turbine as the nozzle ring is closed towards a minimum inlet width appropriate to engine braking or exhaust gas heating operating modes. As explained above a reduction in efficiency in these circumstances may be desirable to help avoid excessive boost pressures which can cause problems in an engine braking or exhaust gas heating mode.

The provision of the rib 33 also allows the inlet width to be reduced to zero since when in abutment with the facing wall of the inlet, i.e. the shroud 12, the rib 33 makes the contact. If the rib 33 and shroud 12 are appropriately machined or otherwise formed or affixed (for example, by molding, welding, fastening or a combination thereof), the contact between the two may for instance make a hermetic seal. Where other structure is provided to ensure a minimum flow when the inlet width is reduced to zero, fully closing the nozzle ring 30 in an engine braking or exhaust gas heating mode avoids the problem of finely balancing the nozzle ring 30 actuating force with a load on the face 31 of the nozzle ring 30 resulting from gas pressure within the inlet 9. Accordingly, the provision of the annular rib 33 can facilitate significant improvement in the positional control of the nozzle ring during engine braking and/or exhaust gas heating operating modes, with a resultant improvement in the control of the braking or heating effect. In such cases, the size of the minimum leakage flow can also be defined independently of the minimum size of the inlet since this will not vary if the nozzle ring is fully closed.

Figure 5A:
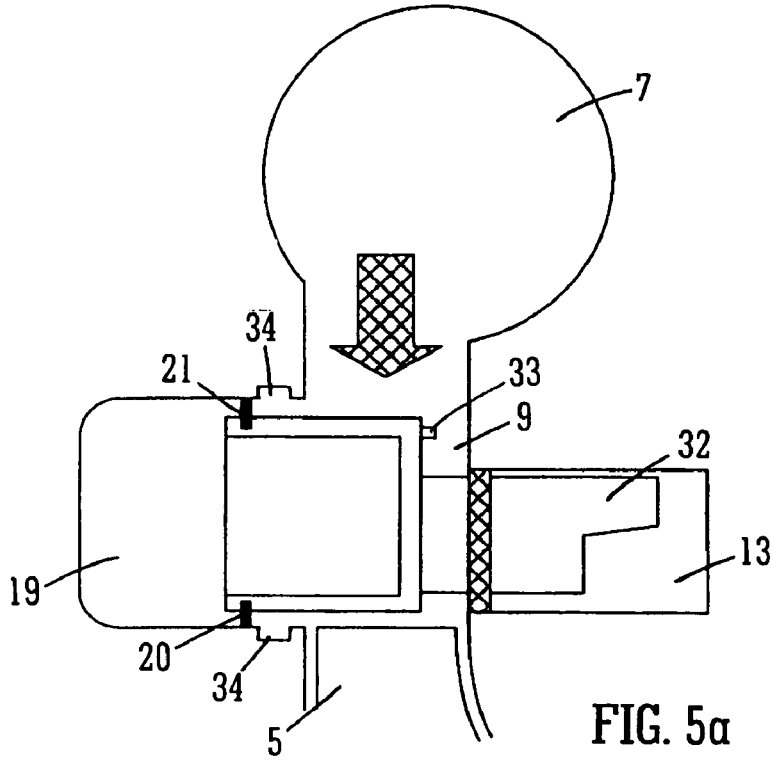
FIGS. 5*a* and 5*b* illustrate a modification of the embodiment of the invention illustrated in FIG. 4.
Figure 5B:
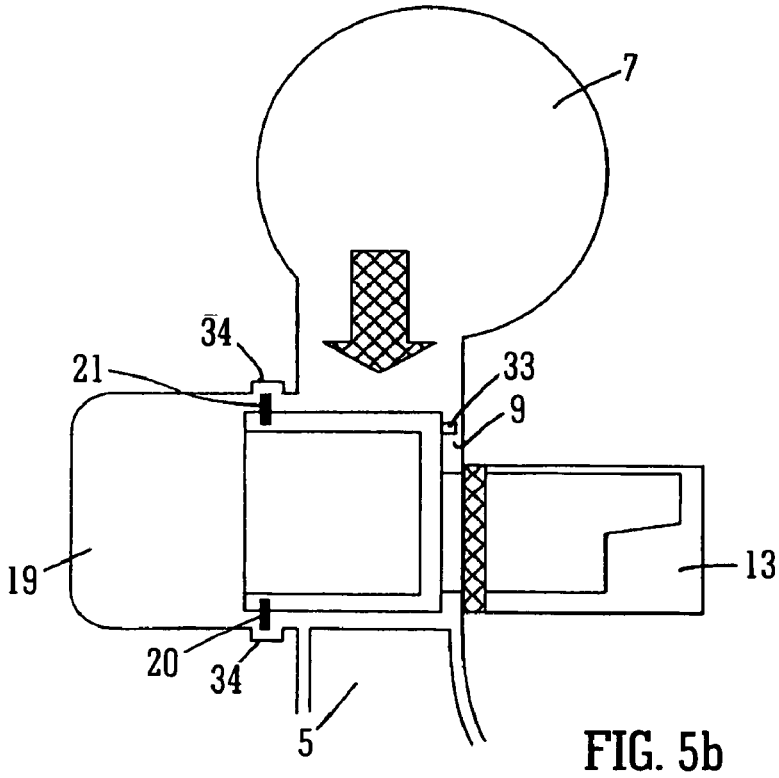

For example, FIGS. 5*a* and 5*b* illustrate an embodiment of the present invention in which a bypass gas flow path is provided in accordance with the teaching of EP 1435434. The illustrated example is a modification of the embodiment illustrated in FIG. 4 and like reference numerals are used where appropriate. In this particular embodiment the bypass path is defined by a circumferential array of recesses 34 (or a continuous annular recess) in each of the radially inner and outer walls of the nozzle ring cavity 19. As shown in FIG. 5*a*, with the nozzle ring 30 in a position corresponding to a minimum inlet width for a normal engine fired mode the seals 20 and 21 carried by the nozzle ring 30 prevent any flow of gas around the back of the nozzle ring 30 through the nozzle ring cavity 19. However, as shown in FIG. 5*b*, with the nozzle ring 30 closed to reduce the inlet 9 to a minimum width appropriate to an engine braking or exhaust gas heating mode, the seals 20 and 21 register with the recesses 34 so that gas can flow past the seals 20 and 21 through the recesses 34 through the cavity 19, and thus bypass the inlet passage 9, and in particular the inlet guide vanes 32. The gas which bypasses the inlet passage 9 and inlet guide vanes 32 generates less work from the turbine wheel 5 so that efficiency of the turbocharger drops with the advantages explained above. In addition, the bypass path can ensure there is a minimum leakage flow through the turbine even if the nozzle ring 30 is fully closed with the rib 33 abutting the shroud 12. Thus as mentioned above, when fully closed the positional control of the nozzle ring is simplified, and the size of the leakage path is precisely defined by the bypass path.

The particular bypass path arrangement shown in FIGS. 5*a* and 5*b* is only one possibility for providing a minimum flow even with the nozzle ring fully closed. For instance there are a number of other bypass path arrangements described in EP 1435434 all of which can be combined with the annular rib 33 according to the present invention by modifying the nozzle ring 30 and/or nozzle ring cavity 19 appropriately.

Figure 6B:
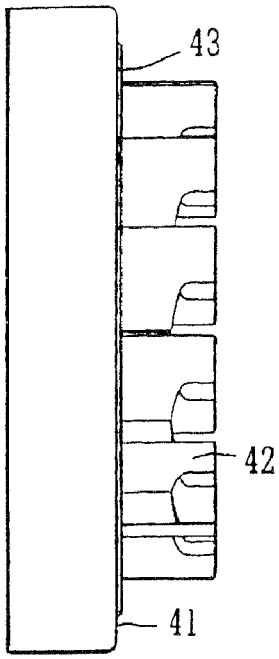
FIGS. 6*a* and 6*b* illustrate a further nozzle ring in accordance with the present invention.
Figure 6A:
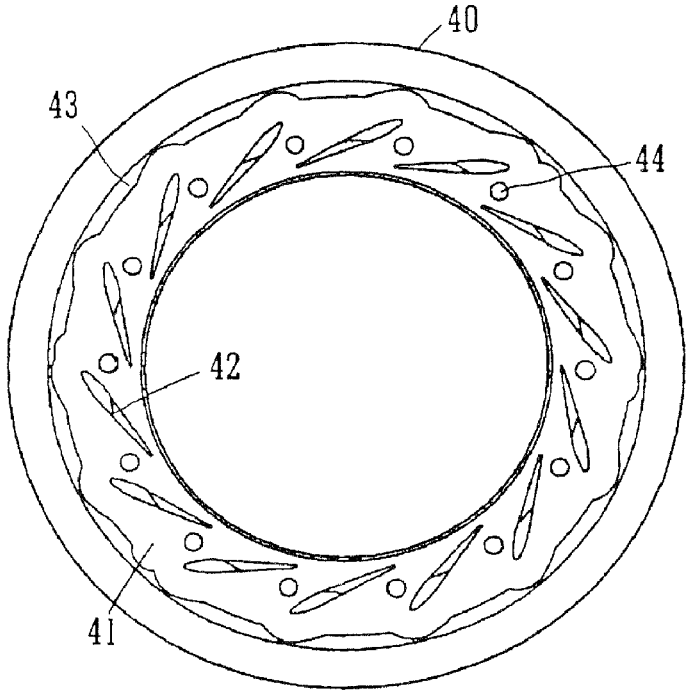
Figure 7:
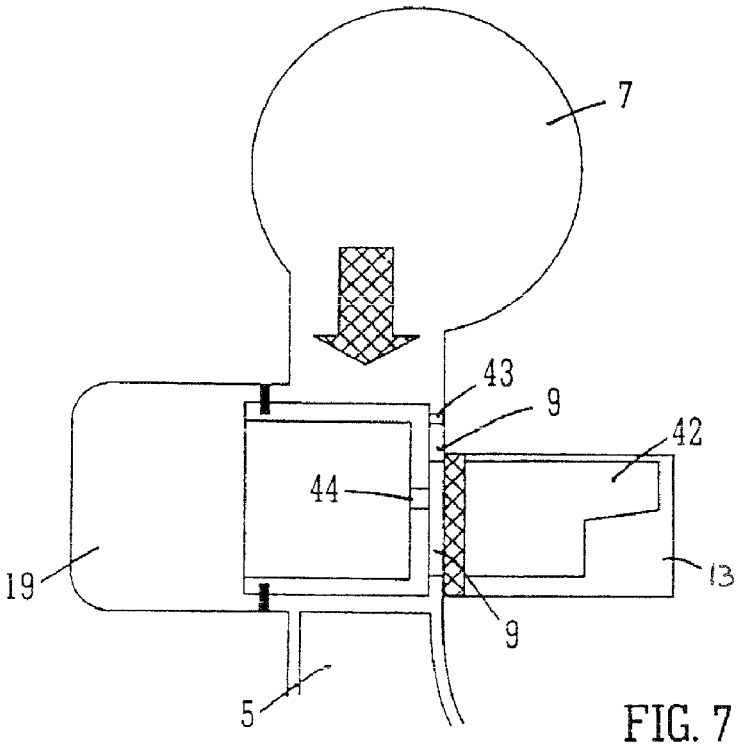
FIG. 7 illustrates a variable geometry turbine inlet structure according to the present invention including the nozzle ring of FIGS. 6*a* and 6*b;*

Another inlet feature that can be combined with the annular rib according to the present invention with advantageous effect is the provision of pressure balancing holes as disclosed in EP 0654587 mentioned above. A modification of the nozzle ring shown in FIGS. 3*a* and 3*b* provided with pressure balancing holes is shown in FIGS. 6*a* and 6*b*. FIG. 7 is a cross-section through the turbine inlet illustrating the nozzle ring of FIG. 6 in a fully closed position. From FIGS. 6*a* and 6*b* it can be seen that the modified nozzle ring 40 is identical to that shown in FIGS. 3*a* and 3*b* except for the presence of pressure balance holes 44 through the face 41 of the nozzle ring 40 between vanes 42. From FIG. 7 it will be evident that even when the nozzle ring is fully closed with the rib 43 abutting the shroud 12 to reduce the width of the inlet 9 to zero there is space between the face of the nozzle ring 41 and the shroud 12 resulting from projection of the rib 43 from the face 41. The pressure balance holes 44 therefore remain in communication with the inlet 9 and turbine outlet downstream of the rib 43. This ensures that the pressure balancing holes 44 continue to perform a load balancing function even when the nozzle ring 40 is fully closed. This improves control of the position of the nozzle ring at minimum inlet widths, for instance reducing the tendency for the nozzle ring 40 to snap shut as it approaches a fully closed position, and also reduces the force necessary to open the nozzle ring 40 from the fully closed position. Thus the effects of the rib 43 and the pressure balancing holes 44 combine to improve control over movement and positioning of the nozzle ring 40 at inlet widths appropriate to engine braking and exhaust heating modes thereby improving control over the braking or heating effects.

The pressure balance holes can of course be combined with structure providing a bypass or leakage flow as mentioned above. For example, pressure balance apertures can be combined with any of the bypass path structures described in EP1435434 in combination with the rib according to the present invention. For instance the nozzle ring of FIGS. 6*a* and 6*b* can be modified to provide a bypass gas path for accordance with the teaching of EP1435434 as shown for example in FIGS. 8*a* and 8*b*.

Figure 8B:
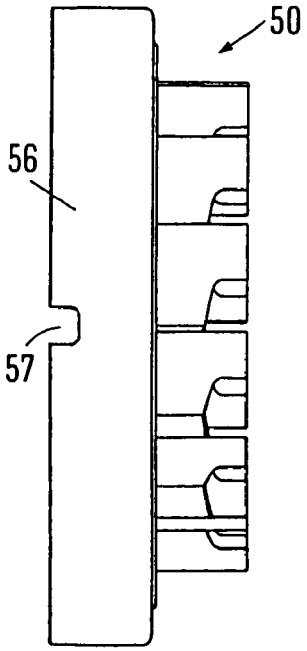
FIGS. 8*a* and 8*b* illustrate a further nozzle ring in accordance with the present invention.
Figure 8A:
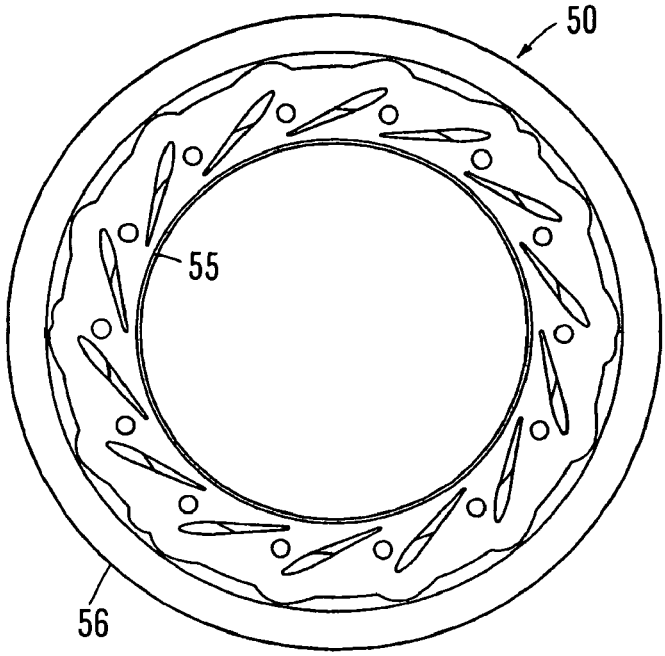

As can be seen from FIGS. 8*a* and 8*b*, the inner and outer radial flanges 55 and 56 of a modified nozzle ring 50 are each provided with bypass path apertures in the form of bypass slots 57. Otherwise, the illustrated nozzle ring 50 is identical to the nozzle ring according to the present invention illustrated in FIGS. 6*a* and 6*b*.

Figure 9A:
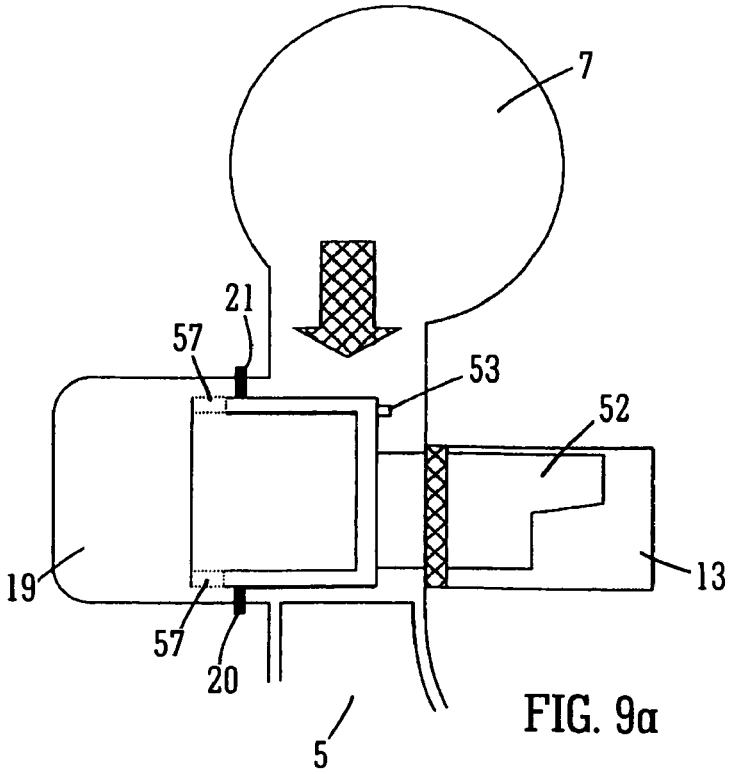
FIGS. 9*a* and 9*b* illustrate a variable geometry turbine inlet in accordance with the present invention including the nozzle ring of FIGS. 8*a* and 8*b;*
Figure 9B:
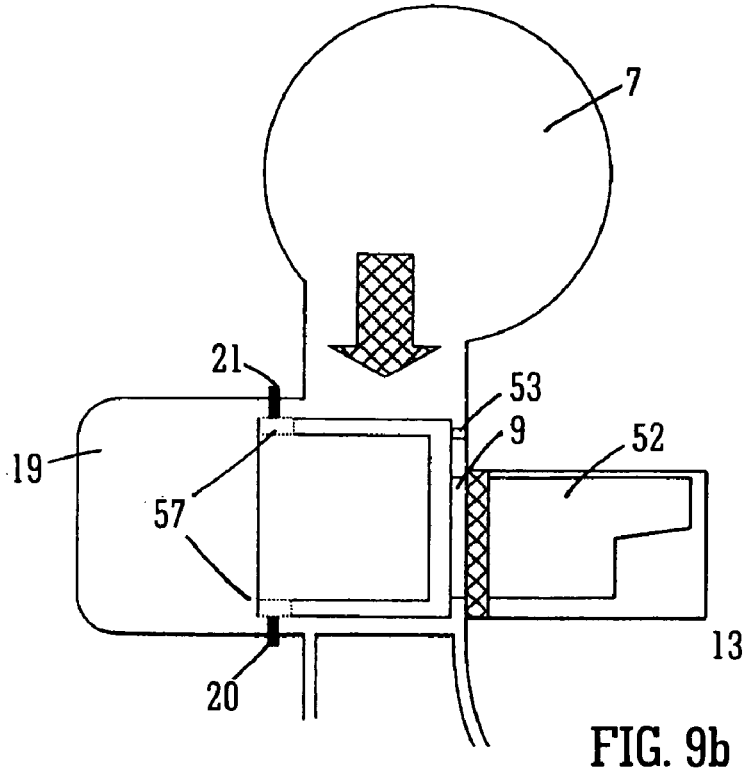

FIG. 9*a* is a cross section corresponding to FIG. 7 but with the nozzle ring of FIGS. 8*a* and 8*b*. This shows the nozzle ring in a fully closed position from which it can be seen that the bypass apertures, i.e. bypass slots 57, register with inner and outer radial seals 20, 21 which are located in respective grooves in the inner and outer radial walls of the nozzle ring cavity 19. It will be appreciated that if the nozzle ring is moved to open the inlet 9 to a minimum width appropriate to a normal engine fired mode operating condition, as for instance illustrated in FIG. 9*b*, the slots 57 will move into the cavity 19 inboard of the seals 20, 21 and thus close off the bypass path. This is only one of the possible alternative arrangements for forming a bypass gas passage in accordance with the teaching of EP1435434 which can be incorporated in the present invention.

Figure 10:
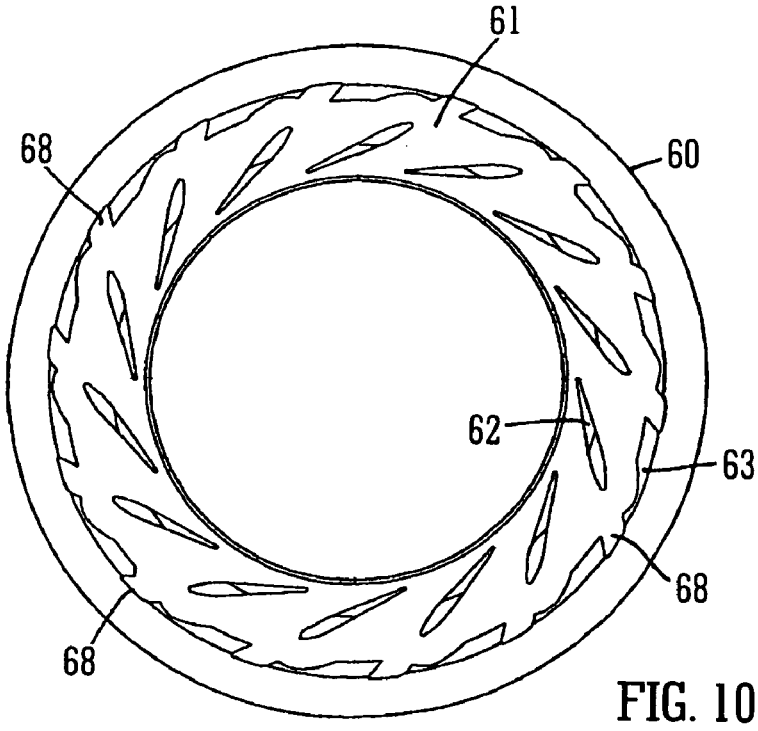
FIG. 10 illustrates a further embodiment of a nozzle ring in accordance with the present invention.
Figure 11:
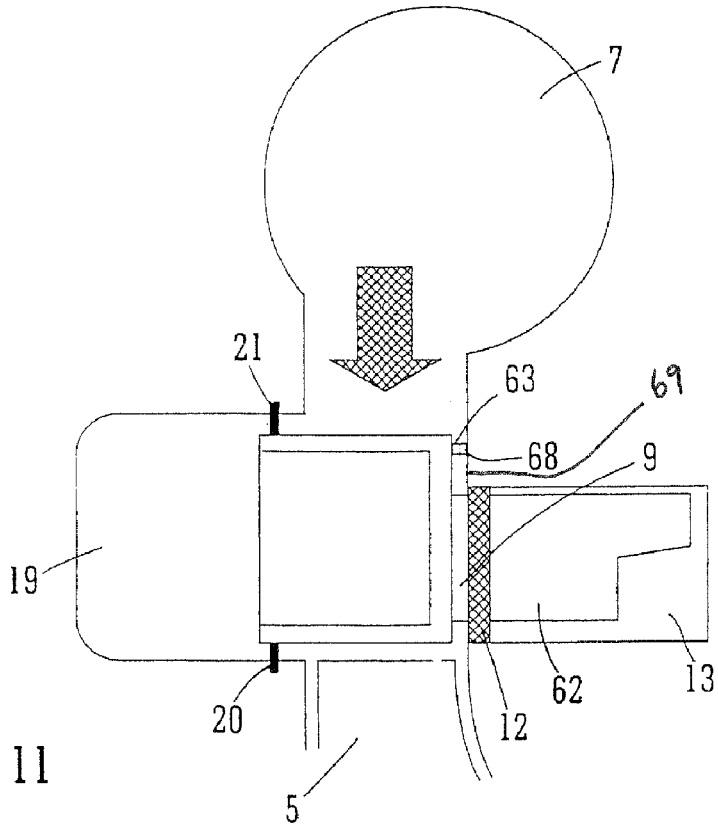
FIG. 11 illustrates a variable geometry turbine inlet according to the present invention including the nozzle ring of FIG. 10.

FIG. 10 illustrates another modification of the nozzle ring illustrated in FIGS. 3*a* and 3*b*, in accordance with the present invention. Referring first to FIG. 10, the illustrated nozzle ring 60 has a nozzle rib 63 provided with radial slots 68 so that the height of the rib 63 above the face 61 of the nozzle ring 60 is reduced at the location of each slot 68. The main effect of this modification is illustrated in FIG. 11 which shows the nozzle ring 60 in a fully closed position in which the rib 63 abuts a facing wall 69 of the inlet passageway 9. The slots 61 define openings, or leakage flow paths, through which a leakage gas flow may flow through the inlet passageway 9 even when the nozzle ring is fully closed. In FIG. 11 the leakage slots 68 are shown as extending only part way into the rib 63 for clarity. It will be appreciated that the slots could also extend to the face 68 of the nozzle ring as shown in FIG. 10.

With this embodiment of the invention it is not therefore necessary to take any other measure, or to provide any other structure, in order to ensure a minimum gas flow through the turbine when the turbocharger is operated in an exhaust gas heating or engine braking mode and the nozzle ring is in a fully closed position. Control over the position of the nozzle ring 60 is improved, since the nozzle ring may be fully closed in an engine braking or exhaust heating mode, and in addition the size of the leakage flow path can be precisely defined and provided in an advantageously simple structure.

Moreover, the leakage slots 68 in the rib 63 can be configured to reduce the efficiency of the turbine at small inlet widths appropriate to engine braking or exhaust gas heating modes with the advantage described above. The efficiency reducing effect can be for instance be achieved (or enhanced) by positioning and configuring at some leakage slots 68 to direct gas flow on to the leading edges of inlet vanes 62, or at the sides of inlet vanes so that effect of the vanes on the flow is reduced. For instance, efficiency reduction comparable to that achieved with the bypass path structures of EP1435434 can be achieved with an advantageously simple structure which at the same time allows complete control of the size of the minimum gas flow path.

The size of the minimum flow permitted can be varied between different applications by variation of such parameters as the size and number of the slots.

The magnitude of the efficiency reducing effect for a given minimum flow could similarly be varied between nozzle rings by appropriate changes to the number, positioning and configuration (e.g. size, shape and orientation) of the slots. For instance some slots could be designed to direct gas onto vane leading edges and other slots could be designed to direct gas between vanes. Alternatively the degree to which one or more of the slots directs air on to the leading edges of vanes could for instance be varied. As another possibility one or more slots could be configured to direct air in a counter direction to the rotation of the turbine wheel. Many other possibilities will be apparent to the skilled person.

Figure 12:
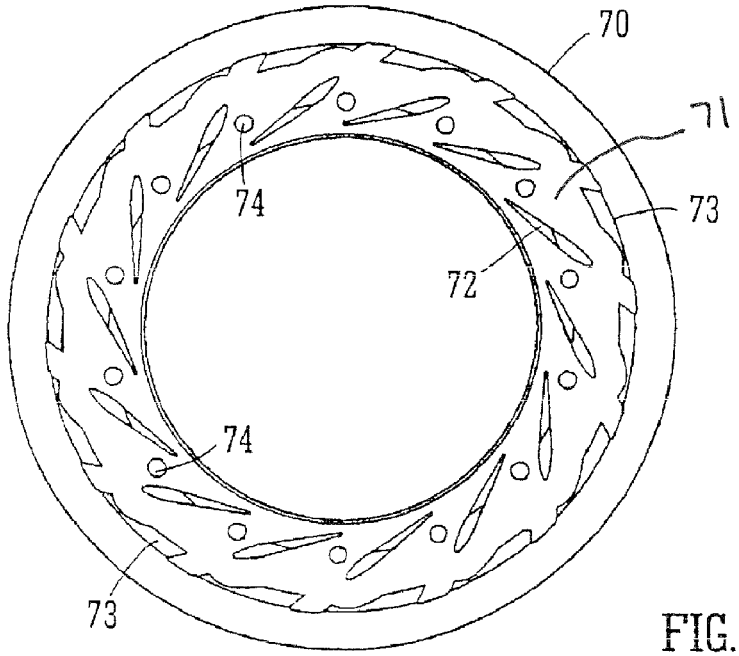
FIG. 12 illustrates a further nozzle ring in accordance with an embodiment of the present invention.

It will be appreciated that the nozzle ring of FIG. 10 may be modified by the provision of pressure balance holes as shown in FIG. 12 to provide the further advantages discussed above in relation to FIGS. 6 and 7. The nozzle ring 70 of FIG. 12 has pressure balance holes 74 provided through its face 71 between vanes 72 (ribs 73 also shown in this figure).

Figure 13A:
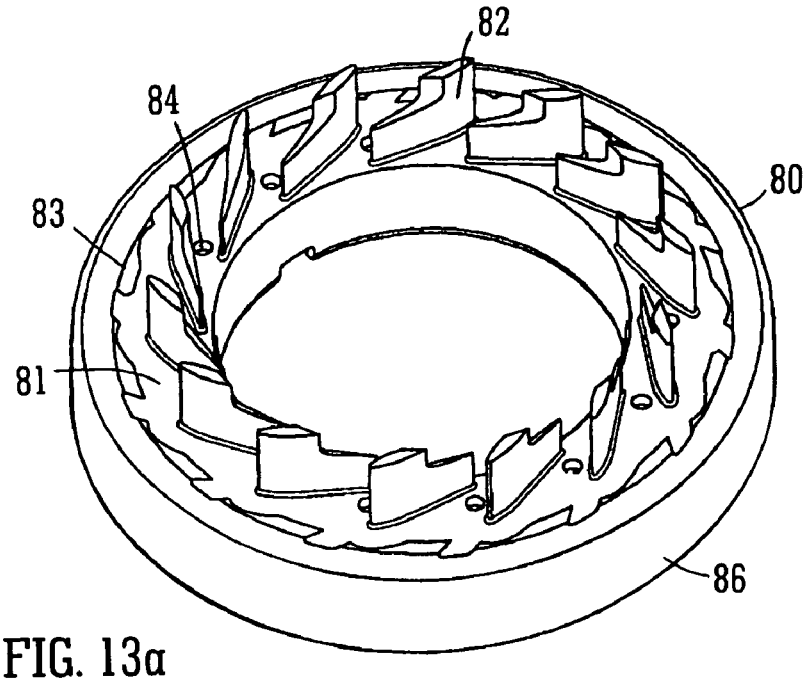
FIGS. 13*a* and 13*b* illustrate a further embodiment of a nozzle ring in accordance with the present invention, which is a modification of the nozzle ring illustrated in FIG. 12.
Figure 13B:
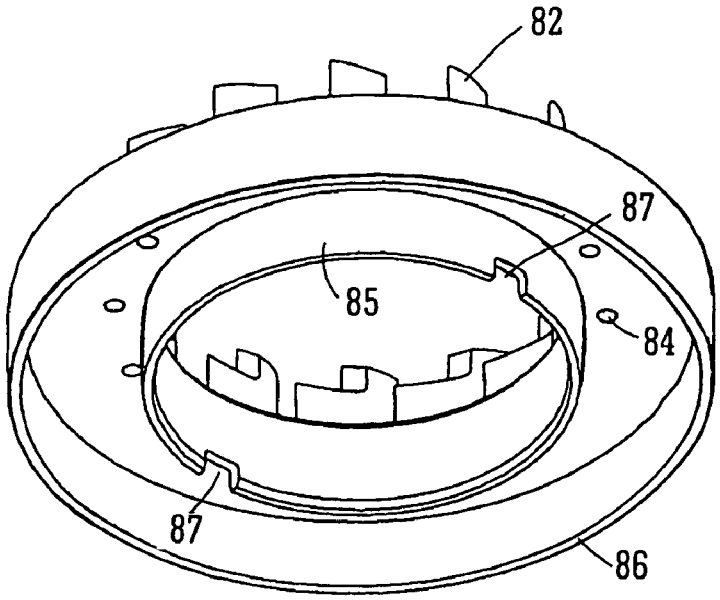

In addition the leakage slots in combination with the pressure balance apertures can define part of a bypass gas path to reduce (or further reduce) turbine efficiency when operated in an engine braking or exhaust gas heating mode as taught in EP 1435434. An example of this is shown in FIGS. 13*a* and 13*b* which illustrate a nozzle ring 80 which is essentially the nozzle ring of FIG. 12 but modified to include bypass slots 87 in the inner nozzle ring flange 85 (shown in FIG. 13) only. Also shown in one and/or both FIGS. 13*a* and 13*b* are face 81, vanes 82, and outer nozzle ring flange 86.

Figure 14:
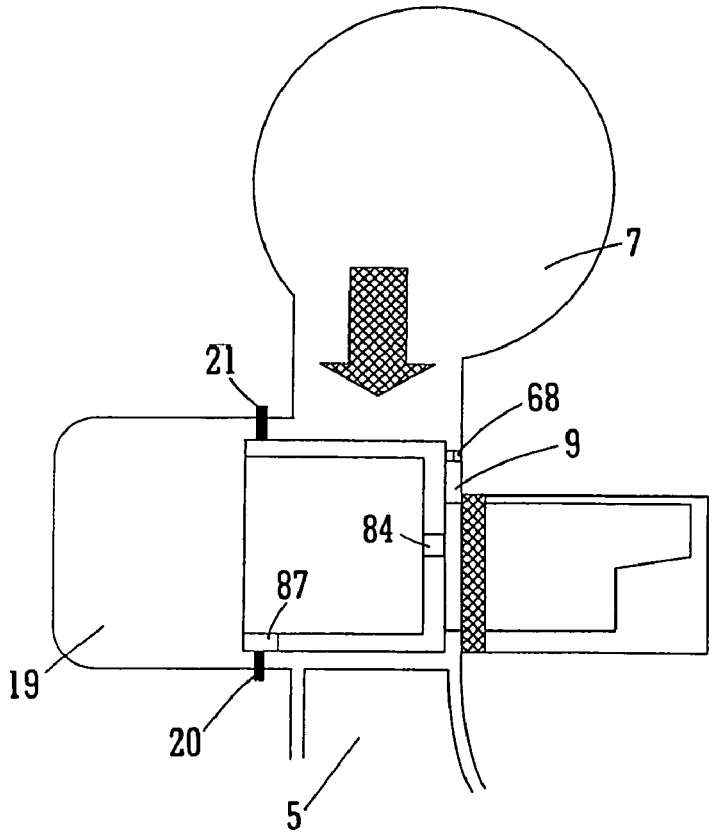
FIG. 14 illustrates a variable geometry turbine inlet according to the present invention including the nozzle ring of FIGS. 13*a* and 13*b;*

FIG. 14 illustrates the nozzle ring 80 in a fully closed position with the rib 83 abutting the inlet shroud 12. During normal engine fired mode operation the inner flange seal 20 in combination with the outer flange seal 21 prevents any gas flow through the nozzle ring cavity 19. However, at nozzle ring positions (including a fully closed position as illustrated) appropriate to engine braking or exhaust gas heating operating modes, the inner flange seal 20 registers with the bypass slots 87 to provide a flow path from the pressure balance holes 84 so that some gas flow bypass the inlet 9 and vane portions downstream of the pressure balancing holes 84. Even when the nozzle ring 80 is fully closed the pressure balance holes 84 remain exposed to gas flow through the inlet 9 via the leakage slots. Turbine efficiency will therefore drop as it nozzle ring is closed towards a minimum inlet width appropriate to engine braking and exhaust gas heating modes with the advantages discussed above. Efficiency reducing effects of the leakage slots and bypass path could for instance be combined to possibly achieve greater efficiency reduction than could be achieved by either measure alone. If the turbine is operated so that the nozzle ring is fully closed in an engine braking or exhaust heating operating mode, the position of the nozzle ring can again be more easily controlled and the size of the minimum flow path can be precisely defined.

The embodiment of the invention illustrated in FIG. 14 can be modified to provide alternative forms of gas bypass path, including the other possibilities taught in EP 1435434. For instance, the nozzle ring 80 could be provided with bypass slots in its outer flange as well as its inner flange (i.e. the arrangement shown in FIGS. 9*a* and 9*b*) or instead of the bypass slots formed in the nozzle ring, bypass recesses could be provided in the inner and/or outer walls of the nozzle ring cavity 19 (as for instance shown in FIGS. 5*a* and 5*b*). It will also be appreciated that in such embodiments the pressure balance holes could be omitted, for instance to produce embodiments of the invention similar to that shown in FIGS. 5*a* and 5*b* but in which the nozzle ring rib is provided with leakage slots.

Similarly embodiments of the invention with leakage slots in the rib can be combined with other structure for providing leakage flow through the turbine.

In the embodiments of the invention illustrated in FIGS. 8 to 12 as described above, the flow through the inlet passageway when the nozzle ring is fully closed is permitted by leakage paths defined by the leakage slots provided in the rib. However, it will be appreciated that apertures defining the leakage paths through the rib could be provided in other ways, such as for instance by holes extending radially through the rib, or by a combination of holes and slots in the rib. The size, the shape, positioning and configuration of the holes may be varied to modify their effect in the same way that the slots can be varied as mentioned above. Similarly the leakage paths could be provided by other variations in the configuration of the rib, such as "gentle" undulations in the axial surface of the rib forming peaks and troughs in the height of the rib above the face of the nozzle ring. Such a series of shallow troughs could be regarded as wide shallow slots.

Figure 15:
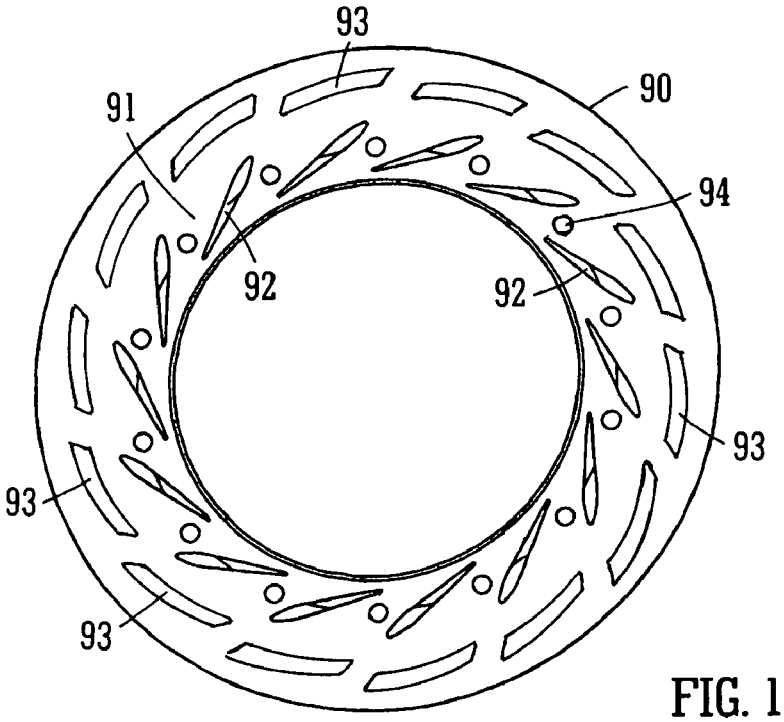
FIG. 15 illustrates a further embodiment of a nozzle ring in accordance with the present invention.

It will also be appreciated that where slots define the leakage paths, particularly if leakage slots provided in the nozzle ring rib extend to the plane of the face of the nozzle ring, the rib may be viewed as comprising an annular array of circumferentially spaced projections or rib portions, the spaces between the rib portions being formed by the slots. The configuration of the slots, in combination with the radially inner and outer profile of the rib, will define the configuration of the rib portions. For instance, FIG. 15 illustrates a modification of the embodiment of the invention illustrated in FIGS. 13*a* and 13*b* in which the slots and rib profiles are such that the nozzle ring rib effectively comprises an annular array of arcuate rib portions 93 which are swept in the same direction as the vanes 92 relative to the rotation of the turbine wheel. With this particular embodiment each rib portion 93 has an arcuate profile, one end of each rib portion being the closest to the axis of the nozzle ring than the adjacent end of a neighbouring rib portion 93.

It will also be appreciated that where slots define the leakage paths, particularly if leakage slots provided in the nozzle ring rib extend to the plane of the face of the nozzle ring, the rib may be viewed as comprising an annular array of circumferentially spaced projections or rib portions, the spaces between the rib portions being formed by the slots. The configuration of the slots, in combination with the radially inner and outer profile of the rib, will define the configuration of the rib portions. For instance, FIG. 15 illustrates a modification of the embodiment of the invention illustrated in FIGS. 13*a* and 13*b* in which the slots and rib profiles are such that the nozzle ring rib effectively comprises an annular array of arcuate rib portions 93 which are swept in the same direction as the vanes 92 relative to the rotation of the turbine wheel. FIG. 15 also discloses nozzle ring 90, face 91, and pressure balance holes 94. With this particular embodiment each rib portion 93 has an arcuate profile, one end of each rib portion being the closest to the axis of the nozzle ring than the adjacent end of a neighbouring rib portion 93.

A common feature of all of the embodiments of the invention described above is that the leakage flow passages between the nozzle ring face and opposing wall of the nozzle ring are formed by apertures (e.g. slots or holes) defined by the rib.

Figure 16:
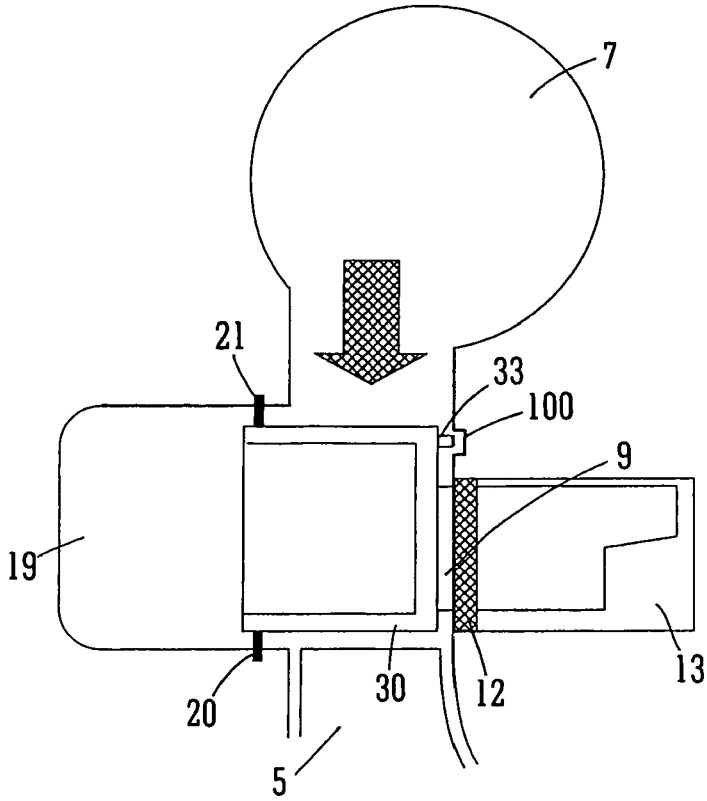
FIG. 16 illustrates a further variable geometry turbine inlet structure in accordance with an embodiment of the present invention.

Alternatively, leakage flow passages could be provided by appropriately configured formations provided in the opposing wall of the inlet passageway, such as the shroud. For instance, FIG. 16 illustrated a modification of the embodiment of the invention illustrated in FIG. 4 in which rather than providing the rib 33 with leakage the nozzle ring has no apertures (e.g. slots or holes) as for instance shown in FIG. 11 but rather an annular array of recesses 100 is defined in the opposing wall of the inlet passage 9 at a radius corresponding to the radius of the nozzle ring rib 33. When the nozzle ring is fully closed (as shown in FIG. 16) gas can flow through the inlet past the nozzle ring 30 via the recesses 100 which together with the rib 33 define leakage flow passages.

It will be appreciated that the embodiments of the invention shown in FIGS. 5*a*, 5*b*, 7, 9*a*, 9*b* and 14 for example could similarly be modified by the provision of recesses in the wall of the inlet 9 opposing the nozzle ring face to provide leakage flow paths past the nozzle ring rib in the manner shown in FIG. 16.

With embodiments of invention such as illustrated in FIG. 16, in which recesses 100 define the leakage flow path the size of the leakage flow path, can be modified by changing the size, configuration and number of the recesses. Similarly any efficiency reducing effect of the recesses can also be modified by a variation in the size, positioning and configuration of the recesses in the general manner discussed above in relation to the rib leakage apertures. Furthermore, it will be appreciated that embodiments of the invention could combine leakage apertures in the rib with recesses or other leakage channels defined the opposing wall of the inlet passageway. For instance leakage flow passages can be defined in part by slots provided in the rib and in part by recesses defined in the surface of the shroud which may or may not register with each other when the nozzle ring is full closed.

Figure 17:
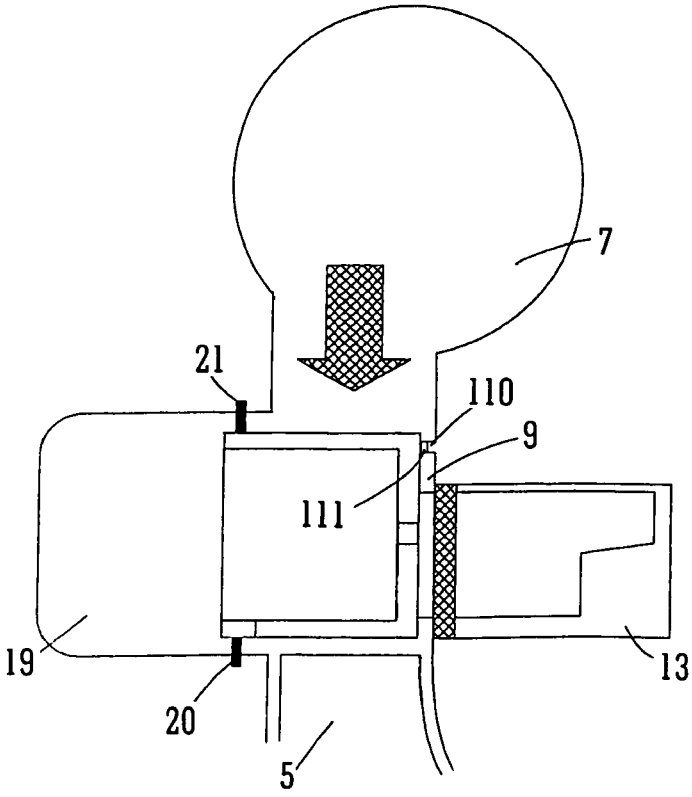
FIG. 17 illustrates a further variable geometry turbine inlet structure in accordance with an embodiment of the present invention.
Figure 18:
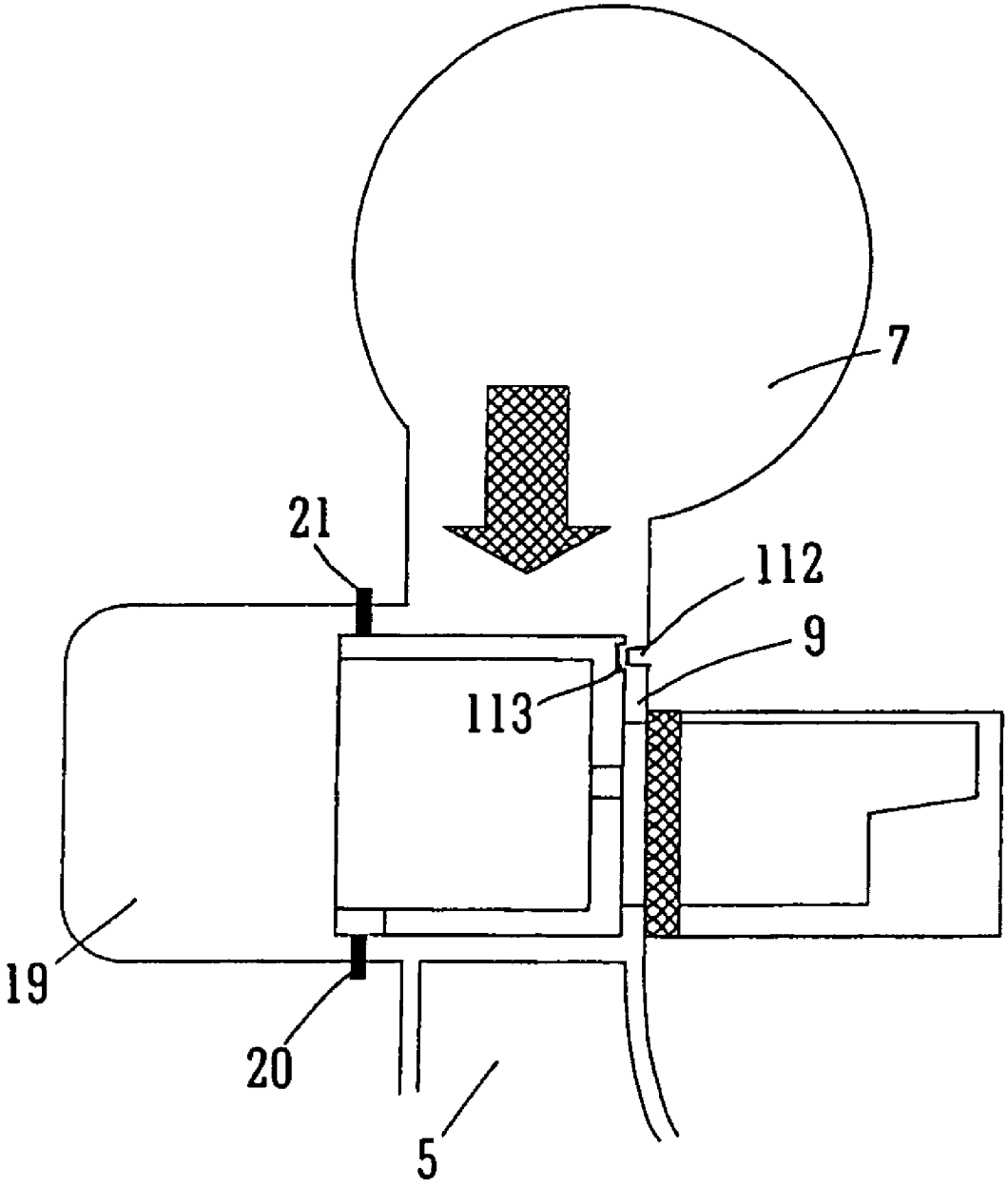
FIG. 18 illustrates a further variable geometry turbine inlet structure in accordance with an embodiment of the present invention

A feature which all of the above-described embodiments of the invention share is that that a rib is provided on the face of the nozzle ring. As an alternative to all of the embodiments of the invention described above the rib could instead be provided on the surface of the wall of the inlet passageway opposing the nozzle ring (e.g. the shroud) In such embodiments of the invention the rib can have any appropriate configuration including all of the configurations described above so that gas leakage passages are defined between the rib and the face of the nozzle ring or through the rib. Similarly, leakage gas passages can be formed by providing channels or the like in the face of the nozzle ring which allow gas to flow past the rib when the nozzle ring is fully closed. In other words, all of the embodiments of the invention described above have analogous embodiments in which the rib is defined on the wall of the inlet passageway opposing the face of the nozzle ring. As one example only, FIG. 17 illustrates a modification of the embodiment of the invention shown in FIG. 14, in which rather than rib 63 provided with slots 68 (as shown in FIG. 14) the nozzle ring itself is not provided with a rib, but the turbine housing wall defining the opposing wall of the inlet is provided with a rib 110 (for instance having the configuration of the rib shown in FIGS. 13*a* and 13*b*), with leakage passages being defined by slots 111 through the rib 110. As another example, FIG. 18 is a modification of the embodiment shown in FIG. 17, in which rib 112 does not have leakage slots but instead the face of the nozzle ring is modified with recesses 113 which align with rib 112 when the nozzle ring is fully closed to form leakage gas passages in substantially the same way as the recesses 100 of the embodiment of FIG. 16 for leakage gas passages around the nozzle ring rib.

It will be appreciated that it will be possible to configure embodiments of the present invention with rib portions defined on both the nozzle ring and opposing wall of the inlet passage. For instance, rib portions projecting from both the nozzle ring and opposing wall of the inlet passage could abut one another when the nozzle ring is fully closed, or could be configured to interdigitate when the nozzle ring is fully closed.

Embodiments of the invention could combine features from all of the above described embodiments of the invention.

The invention claimed is:

1. A method of operating a turbocharger fitted to an internal combustion engine, the turbocharger including a variable geometry turbine comprising:

a turbine wheel supported in a housing for rotation about a turbine axis;

an annular inlet passageway defined between a radial face of a movable wall member and a facing wall of the housing;

the movable wall member being movable along the turbine axis to vary the width of the inlet passageway;

a substantially annular rib being provided on said facing wall of the housing such that the minimum width of the inlet passageway is defined between the rib and a portion of the face of the movable wall member;

the method comprising operating the engine in an engine braking mode in which a fuel supply to the engine is stopped and the movable wall member is moved to reduce the width of the turbine inlet passageway.

2. A method according to claim 1, wherein in said engine braking mode the movable wall member is moved into a fully closed position in which the movable wall member abuts the opposing wall of the turbine housing.

3. A method of operating a turbocharger fitted to an internal combustion engine, the turbocharger including a variable geometry turbine comprising:

a turbine wheel supported in a housing for rotation about a turbine axis;

an annular inlet passageway defined between a radial face of a movable wall member and a facing wall of the housing;

the movable wall member being movable along the turbine axis to vary the width of the inlet passageway;

a substantially annular rib being provided on said facing wall of the housing such that the minimum width of the inlet passageway is defined between the rib and a portion of the face of the movable wall member;

the method comprising operating the engine in an exhaust gas heating mode in which the width of the inlet is reduced below a width appropriate to a normal engine operating range to raise the temperature of exhaust gas passing through the turbine.

4. A method according to claim 3, wherein in said exhaust gas heating mode the movable wall member is moved into a fully closed position in which the movable wall member abuts the opposing wall of the turbine housing.

5. A method of operating a turbocharger fitted to an internal combustion engine, the turbocharger including a variable geometry turbine comprising:

a turbine wheel supported in a housing for rotation about a turbine axis;

an annular inlet passageway defined between a radial face of a movable wall member and a facing wall of the housing;

the movable wall member being movable along the turbine axis to vary the width of the inlet passageway;

a substantially annular rib being provided on said radial face such that the minimum width of the inlet passageway is defined between the rib and a portion of the facing wall of the housing;

the movable wall member being movable into a fully closed position in which the rib abuts said portion of the facing wall of the housing; and wherein the rib is provided with at least one gas passage formation which defines at least part of a gas passage when the movable wall member is in said fully closed position to allow gas to flow through the inlet passageway past said rib;

the method comprising operating the engine in an engine braking mode in which a fuel supply to the engine is stopped and the movable wall member is moved to reduce the width of the turbine inlet passageway.

6. A method according to claim 5, wherein in said engine braking mode the movable wall member is moved into a fully closed position in which the movable wall member abuts the opposing wall of the turbine housing.

7. A method of operating a turbocharger fitted to an internal combustion engine, the turbocharger including a variable geometry turbine comprising:

a turbine wheel supported in a housing for rotation about a turbine axis;

an annular inlet passageway defined between a radial face of a movable wall member and a facing wall of the housing;

the movable wall member being movable along the turbine axis to vary the width of the inlet passageway;

a substantially annular rib being provided on said radial face such that the minimum width of the inlet passageway is defined between the rib and a portion of the facing wall of the housing;

the movable wall member being movable into a fully closed position in which the rib abuts said portion of the facing wall of the housing; and wherein the rib is provided with at least one gas passage formation which defines at least part of a gas passage when the movable wall member is in said fully closed position to allow gas to flow through the inlet passageway past said rib;

the method comprising operating the engine in an exhaust gas heating mode in which the width of the inlet is reduced below a width appropriate to a normal engine operating range to raise the temperature of exhaust gas passing through the turbine.

8. A method according to claim 7, wherein in said exhaust gas heating mode the movable wall member is moved into a fully closed position in which the movable wall member abuts the opposing wall of the turbine housing.

9. A method according to claim 7, wherein the movable wall member is moved to reduce the inlet width for exhaust gas heating in response to determination of the exhaust gas temperature falling below a threshold temperature.

10. A variable geometry turbine comprising;

a turbine wheel supported in a housing for rotation about a turbine axis;

an annular inlet passageway defined between a radial face of a movable wall member and a facing wall of the housing;

the movable wall member being movable along the turbine axis to vary the width of the inlet passageway;

a substantially annular rib being provided on said radial face such that the minimum width of the inlet passageway is defined between the rib and a portion of the facing wall of the housing;

the movable wall member being movable into a fully closed position in which the rib abuts said portion of the facing wall of the housing; and wherein the rib is provided with at least one gas passage formation which defines at least part of a gas passage when the movable wall member is in said fully closed position to allow gas to flow through the inlet passageway past said rib.

11. A variable geometry turbine according to claim 10, wherein in said fully closed position the rib forms a sealing contact with said portion of the facing wall of the housing effective to substantially prevent gas flow through the inlet passageway.

12. A variable geometry turbine according to claim 10, wherein said at least one gas passage formation comprises a circumferentially spaced array of slots provided in the rib.

13. A variable geometry turbine according to claim 12, wherein the slots extend from an axial end of the rib remote from the face of the movable wall member in a direction towards said face, thereby defining an annular array of rib portions spaced apart by said slots.

14. A variable geometry turbine according to claim 13, wherein at least one of said slots has a depth extending at least to the face of the movable wall member.

15. A variable geometry turbine according to claim 13, wherein said slots have a length extending in a direction substantially radial to the turbine axis.

16. A variable geometry turbine according to claim 13, wherein said slots have a length extending in a direction swept forwards or backwards relative to a radial line extending from the turbine axis.

17. A variable geometry turbine according to claim 13, wherein the width of each slot is less than the width of each rib portion defined between said slots.

18. A variable geometry turbine according to claim 10, comprising an annular array of inlet vanes extending across said inlet passageway, such that said rib circumscribes said inlet vanes, and vane passages being defined between adjacent vanes.

19. A variable geometry turbine according to claim 18, wherein said inlet vanes extend from said face of the movable wall member, and said facing wall of the housing is provided with a cavity or cavities to receive said vanes as the movable member is moved towards said facing wall of the housing.

20. A variable geometry turbine according to claim 19, wherein aside from said vanes, the rib extends a greater distance from the face of the movable wall member than any other feature of the movable wall member.

21. A variable geometry turbine according to claim 18, comprising means for bypassing gas flow around at least a portion of said vane passages at inlet passageway widths less than a predetermined value.

22. A variable geometry turbine according to claim 21, wherein said means comprises at least one bypass flow path which opens only when the movable wall member is moved to define an inlet width below said predetermined value, the flow path directing at least some gas flow from the inlet through a cavity defined behind the face of the movable wall member and then to the turbine wheel downstream of the inlet vane passages.

23. A variable geometry turbine according to claim 10, wherein the movable wall member is mounted within an annular cavity provided within the housing, said face of the movable wall member being defined by a radial wall of the movable wall member, wherein a circumferential array of apertures is provided through said radial wall, the apertures being circumscribed by said annular rib such that the inlet passageway downstream of the rib is in fluid communication with said cavity via said apertures.

24. A variable geometry turbine comprising:

a turbine wheel supported in a housing for rotation about a turbine axis;

an annular inlet passageway defined between a radial face of a movable wall member and a facing wall of the housing;

the movable wall member being movable along the turbine axis to vary the width of the inlet passageway;

a substantially annular rib being provided on said facing wall of the housing such that the minimum width of the inlet passageway is defined between the rib and a portion of the face of the movable wall member; and wherein at least one of the rib and said portion of the face of the movable wall member is provided with at least one gas passage formation which defines at least part of a gas passage when the movable wall member is in said fully closed position to allow gas to flow through the inlet passageway past said rib.

25. A variable geometry turbine according to claim 24, wherein the movable wall member is movable into a fully closed position in which the rib abuts said portion of the face of the movable wall member.

26. A variable geometry turbine according to claim 25, wherein in said fully closed position the rib forms a sealing contact with said portion of the face of the moveable wall member effective to substantially prevent gas flow through the inlet passageway.

27. A turbocharger including a variable geometry turbine comprising:

a turbine wheel supported in a housing for rotation about a turbine axis;

an annular inlet passageway defined between a radial face of a movable wall member and a facing wall of the housing;

the movable wall member being movable along the turbine axis to vary the width of the inlet passageway;

a substantially annular rib being provided on said radial face such that the minimum width of the inlet passageway is defined between the rib and a portion of the facing wall of the housing;

the movable wall member being movable into a fully closed position in which the rib abuts said portion of the facing wall of the housing; and wherein the rib is provided with at least one gas passage formation which defines at least part of a gas passage when the movable wall member is in said fully closed position to allow gas to flow through the inlet passageway past said rib.

28. A turbocharger including a variable geometry turbine comprising:

a turbine wheel supported in a housing for rotation about a turbine axis;

an annular inlet passageway defined between a radial face of a movable wall member and a facing wall of the housing;

the movable wall member being movable along the turbine axis to vary the width of the inlet passageway;

a substantially annular rib being provided on said facing wall of the housing such that the minimum width of the inlet passageway is defined between the rib and a portion of the face of the movable wall member; and wherein at least one of the rib and said portion of the face of the movable wall member is provided with at least one gas passage formation which defines at least part of a gas passage when the movable wall member is in fully closed position to allow gas to flow through the inlet passageway past said rib.

29. A variable geometry turbine comprising:

a turbine wheel supported in a housing for rotation about a turbine axis an annular inlet passageway defined between a radial face of a movable wall member and a facing wall of the housing;

the movable wall member being movable along the turbine axis to vary the width of the inlet passageway;

a substantially annular rib being provided on said radial face such that the minimum width of the inlet passageway is defined between the rib and a portion of the facing wall of the housing;

an annular array of inlet vanes extending across said inlet passageway, such that said rib circumscribes said inlet vanes, and vane passages being defined between adjacent vanes;

said inlet vanes extending from said face of the movable wall member, and said facing wall of the housing is provided with a cavity or cavities to receive said vanes as the movable member is moved towards said facing wall of the housing; and wherein aside from said vanes, the rib extends a greater distance from the face of the movable wall member than any other feature of the movable wall member.

30. A variable geometry turbine comprising:

a turbine wheel supported in a housing for rotation about a turbine axis;

an annular inlet passageway defined between a radial face of a movable wall member and a facing wall of the housing;

the movable wall member being movable along the turbine axis to vary the width of the inlet passageway;

a substantially annular rib being provided on said facing wall of the housing such that the minimum width of the inlet passageway is defined between the rib and a portion of the face of the movable wall member;

an annular array of inlet vanes extending across said inlet passageway, such that said rib circumscribes said inlet vanes, and vane passages being defined between adjacent vanes;

said inlet vanes extending from said facing wall of the housing and through respective vane slots provided in said face of the movable wall member to accommodate movement of the movable wall member towards the facing wall of the housing; and wherein aside from said vanes, the rib extends a greater distance from the facing wall of the housing than any other feature of the facing wall of the housing.

* * * * *